United States Patent [19]

Köhler

[11] 4,114,729

[45] Sep. 19, 1978

[54] HALT SELECTOR SYSTEM

[75] Inventor: Ulf Köhler, Skellefteå, Sweden

[73] Assignee: Linden-Alimak AB, Skelleftea, Sweden

[21] Appl. No.: 733,582

[22] Filed: Oct. 18, 1976

[30] Foreign Application Priority Data

Oct. 17, 1975 [SE] Sweden ..... 7511669

[51] Int. Cl.[2] ..... B66B 1/40

[52] U.S. Cl. ..... 187/29 R

[58] Field of Search ..... 187/29

[56] References Cited

U.S. PATENT DOCUMENTS

| | | | |
|---|---|---|---|
| 3,203,506 | 8/1965 | Cummins | 187/29 |
| 3,519,105 | 7/1970 | Geil | 187/29 |
| 3,630,318 | 12/1971 | Stichweh et al. | 187/29 |
| 3,662,861 | 5/1972 | White et al. | 187/29 |
| 3,685,618 | 8/1972 | Takahashi et al. | 187/29 |

*Primary Examiner*—Robert K. Schaefer
*Assistant Examiner*—W. E. Duncanson, Jr.
*Attorney, Agent, or Firm*—Pollock, Vande Sande and Priddy

[57] ABSTRACT

A halt selector system for a vehicle movable along a defined path, such as an elevator, comprises at least one bistable unit associated with each halt position and adapted to assume one state when the vehicle is located at one side of the halt position and its other state when the vehicle is located at the other side of said halt position, and a switch-over device for switching the state of said bistable unit when the vehicle is moving along the path and is at a predetermined distance from the halt position such that the vehicle can be stopped at said halt position. A transmitter, associated with a control circuit which includes the bistable device, is adapted to send one of three distinguishable signals to a receiver and associated operating unit for the drive machinery of the vehicle. The transmitter emits a first signal when the vehicle is at one side of the halt position to indicate that the vehicle is to be driven in one direction, emits a second signal when the vehicle is on the other side of the halt position to indicate that the vehicle is to be driven in the opposite direction, and emits a third signal in response to the switching of state of the bistable device to stop the vehicle at the nearest halt position in the travel direction of the vehicle.

6 Claims, 6 Drawing Figures

V2
R
S
T
Z1
32
1P'
1Q'
1R'
P'1
Q'1
R'1
K'1
K'n
G'1
H'1
G'2
H'2
Z
Jm
Im

HALT SELECTOR SYSTEM

The present invention refers to a halt selector system, especially a floor selecting system for an elevator and will primarily be described in connection with such an elevator, but it is obvious that a selector system of this kind also is applicable in other connections, as e.g. vehicles on rails or conveyors.

In floor selectors for elevators the position of the elevator is usually indicated by having a counter, preferably positioned in the lift cage, stepped forwards or backwards in step with the floors passed by the lift cage, the count of the counter indicating the floor at which the lift cage is located. Especially with cog bar elevators the number of cogs of the cog bar is counted, or the number of revolutions which is performed by the cog wheel engaging the cog bar. The more floors the elevator is intended for, the more complicated such a counter will be, and for a large number of floors it is very difficult to provide a counter which is completely reliable.

When a halt plane is selected the count of the floor counter is compared with the count corresponding to the selected halt plane, and the lift cage is driven in the direction that decreases the difference between these counts until the difference is zero.

To enable a selection of floor both from the halt planes and the lift cage, said cage is provided with selector buttons, one for each floor plane, and each halt plane provided with a CALL button. The switches operated by buttons associated with each halt plane, of which one is in the lift cage and one at the particular halt plane, are usually connected in parallel which means that a separate cable has to be used including the conductors between the switches to the lift cage, which cable usually is attached to, or forms a part of, the supply cable of the elevator and which includes at least as many conductors as the number of halt planes.

The purpose of the invention is to provide a floor selector system, where a separate signal cable for the control of the elevator is not necessary or—alternatively —where the signal cable includes one conductor only but still a reliable control of the elevator is secured. This purpose is realized by providing the selector system according to the invention with the features set forth in the claims.

With the invention, the position of the elevator is no longer indicated by counting the number of passed floors by means of a single counter common to the lift cage and the halt planes, but the position of the elevator with respect to a selected floor plane is indicated separately for the halt planes and then, preferably, by bistable elements provided for each floor which elements are triggered by a switching member positioned at the lift cage and assuming a first position when the lift cage is above the floor plane associated with said element, and a second position when the lift cage is below said floor plane, and separately for the lift cage, and then also preferably by bistable elements, at least one for each floor plane, which—like the above-mentioned elements—assume a first position when the lift cage is above the associated floor plane and a second position when the lift cage is below said plane, and which are triggered by its associated switching element in the elevator shaft. The position of the bistable elements, thus, indicates if the lift cage is above or below the floor plane associated with the respective element, which makes the complexity of the floor indicating system independent of the number of floors which is a very important advantage.

From that selector system which is not positioned near the drive machinery for the elevator, the selection results in transmission, via a conductor in the elevator cable or wirelessly, of a short tone signal to a receiver positioned adjacent the drive machinery, the frequency of said signal indicating to the receiver the direction in which the selected halt plane is positioned with respect to the position of the lift cage. When the lift cage has reached the halt plane at which it should stop a tone signal of a further frequency is sent to the receiver. In this way the elevator machinery is controlled by means of three types of short signals having different frequencies, the first of which indicating that the lift cage is to be driven upwards, the second that the lift cage is to be driven downwards, and the third that the lift cage is to stop at the next halt plane, in the direction of the lift cage. The system according to the invention is at its best for systems where only one floor at a time is to be selected, i.e. where when selecting a floor, simultaneously with the tone signal indicating that the lift cage is to be driven upwards or downwards, a blocking is effected for further selection, said blocking not being cancelled until the lift cage has stopped at the selected floor plane. Through this measure the drive machinery of the elevator is controlled directly by the three tone signals as soon as these occur, so that the lift cage is started to be driven upwards at the occurence of the first tone signal, to be driven downwards at the occurence of the second tone signal, and to stop at the adjacent halt plane—in the travel direction—at the occurence of the third signal.

The system of the invention is, however, also useful for elevators having a so-called wait system, i.e. where selection of a plurality of floors may be effected simultaneously and the lift cage travels sequentially to the selected floors. In this case each tone signal of the first and the second type actuates different circuits in the control means for the elevator machinery, which circuits after having been actuated sequentially control the elevator to be driven in a determined direction as determined by the next circuit in the sequence, and each tone signal of the third type brings the lift cage to stop at the next floor plane in the travel direction.

The invention is described below while referring to the accompanying drawings.

Figure 1:
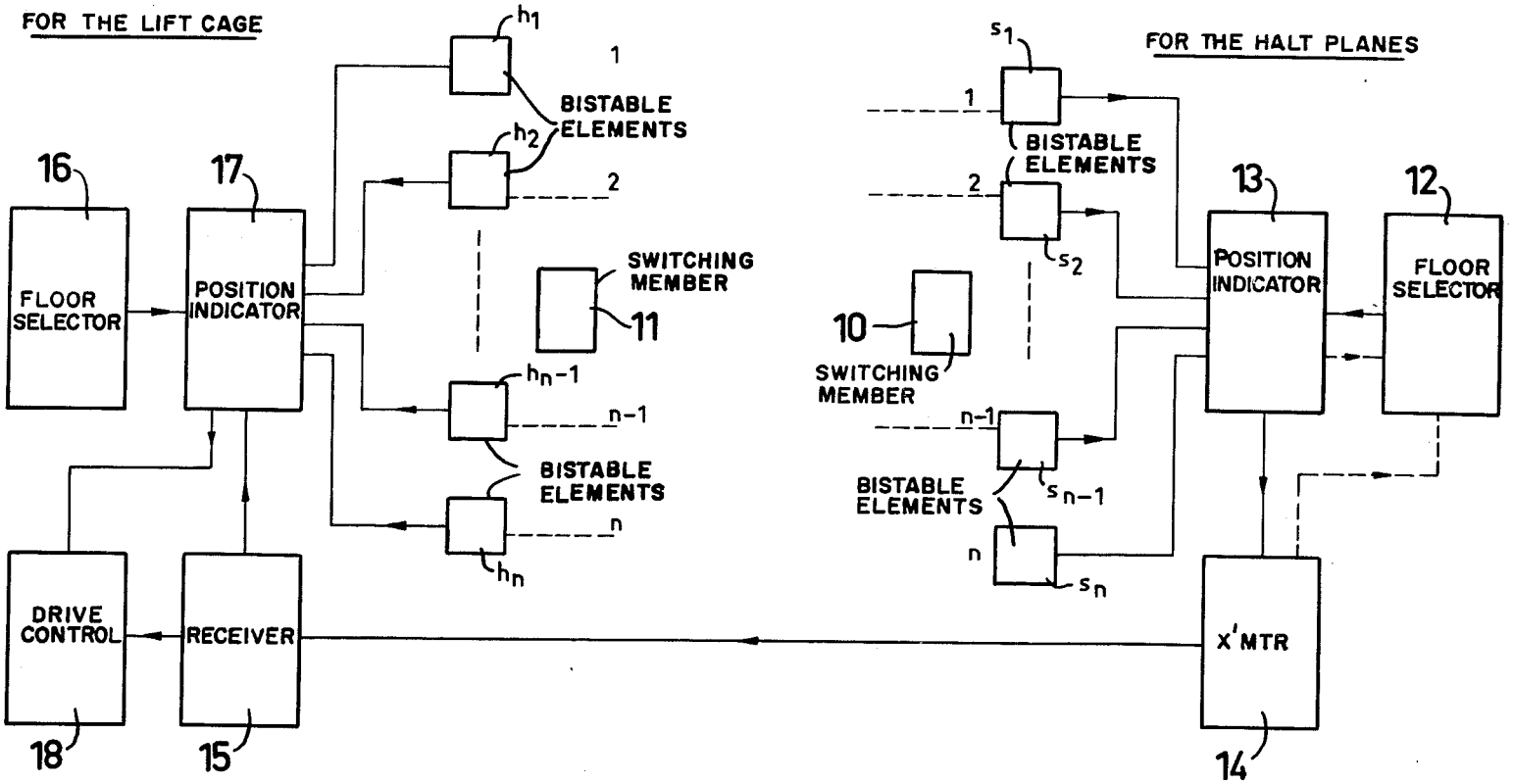
FIG. 1 shows a block diagram of a halt selector system according to the invention.

In the block system shown in FIG. 1 of a selector system of the invention $s_1$–$s_n$ represent, along a path for a vehicle to travel along the path, elements having a position to be switched to a first state by a switching element 10 positioned at the vehicle, when it travels in a first direction, and to a second state by the vehicle when it travels in the second direction, the switching being effected when the vehicle is sufficiently near the next halt station in the travelling direction to be able to stop at this. For the elements $s_1$–$s_n$ the index represents the halt station associated to the element. Instead of a single bistable element for each halt station, two bistable elements may be arranged, one of which is switched to an activated state by a vehicle travelling in one direction, and to a deactivated state by a vehicle travelling in the other direction, and of which the second is switched oppositely to the first element, the two elements being switched to the deactivated state before the vehicle has reached the halt station associated to the element, and to the activated state after that the vehicle has left the halt station.

The bistable elements $s_1$–$s_n$ are connected to a halt station position indicator 13 to which a halt station selector 12 is connected. In the halt station selector 12 the halt station is selected to which the vehicle is desired to go, and at the selection the indicator 13 senses the position of the vehicle with respect to the selected halt station by means of the state of the bistable elements $s_1$–$s_n$. If the vehicle is at one side of the selected halt, when the halt is selected, the indicator 13 controls a transmitter 14 so that it emits a first type of signal, and if the vehicle is at the other side of the selected halt, the indicator controls the transmitter so that it emits a second type of signal. When the vehicle has switched the bistable element $s_i$ associated with the selected halt the indicator 13 controls the transmitter 14 to emit a third type of signal.

The signals emitted by the transmitter are preferably signals of a short duration and each having a different frequency. The signals can be emitted wirelessly but may also be emitted along a suitable conductor, e.g. a current supply line or a protection conductor in the case of a three-phase supply or an additional conducter secured to the supply cable of the elevator.

The signals are received by a receiver 15 positioned near the drive system of the vehicle, in this case positioned at the vehicle. The receiver 15 controls a control arrangement 18 for the drive system of the vehicle in accordance with the type of received signal so that the first signal produces an activating of a first control unit included in the control arrangement to drive the vehicle in one direction, the second signal an activating of a second control unit to drive the vehicle in the other direction, and the third signal a deactivating of the control unit, during the operation of which the control arrangement operates the drive system of the vehicle.

To the control arrangement also a second system of bistable elements $h_1$–$h_n$, a halt position indicator 17 and a halt selector 16, are connected. The bistable elements $h_i$ are switched in accordance with the same principle as the bistable elements $s_i$ but are, in this case, positioned at the vehicle and are switched by switch-over elements 11 along the path, there being for each halt provided at least one switch-over element, preferable two, one at either side of each halt, seen in the travelling direction.

The indicator 17 may operate the control arrangement 18 either directly or via the receiver 15. The receiver 15 may, if the halt selector system of the invention is to operate with a selection of one halt only at the time, also when receiving either the first or the second signal from the transmitter 14 be adapted to block the indicator 17 or the selector 16 so that no selection of another halt can take place after that either one or the other signal from the transmitter 14 has been received by the receiver 15. Likewise, the indicator 17 can block the receipt of signals from the receiver 15 when a selection of halt made by the selector 16 has occured. Each halt selector 12 or 16, respectively, is in this case blocked from further selection of halt as soon as a selection of halt has been made thereby.

Figure 2:
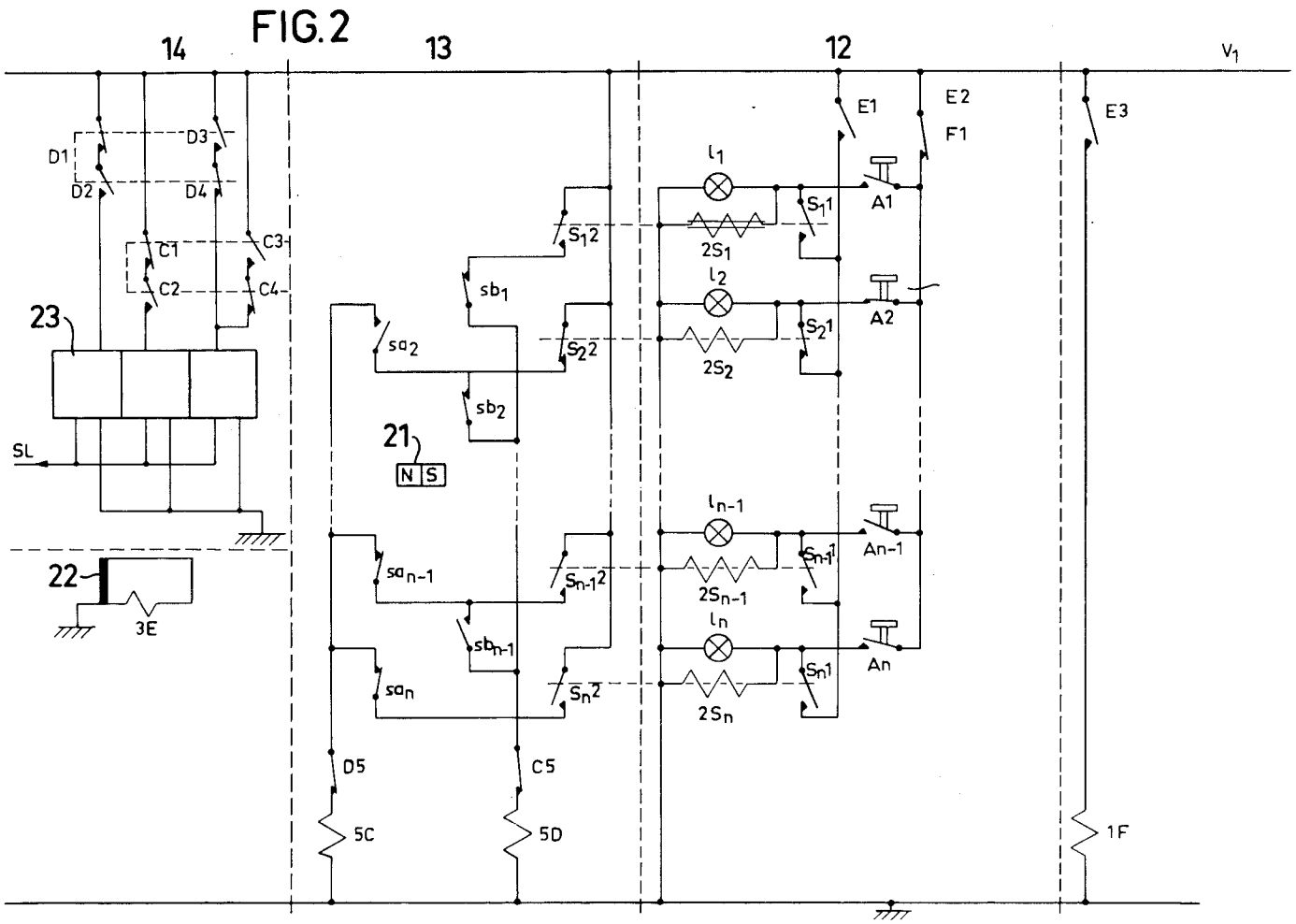
FIGS. 2, 3 and 4 show an embodiment of the selector system of the invention for an elevator without wait system.
Figure 3:
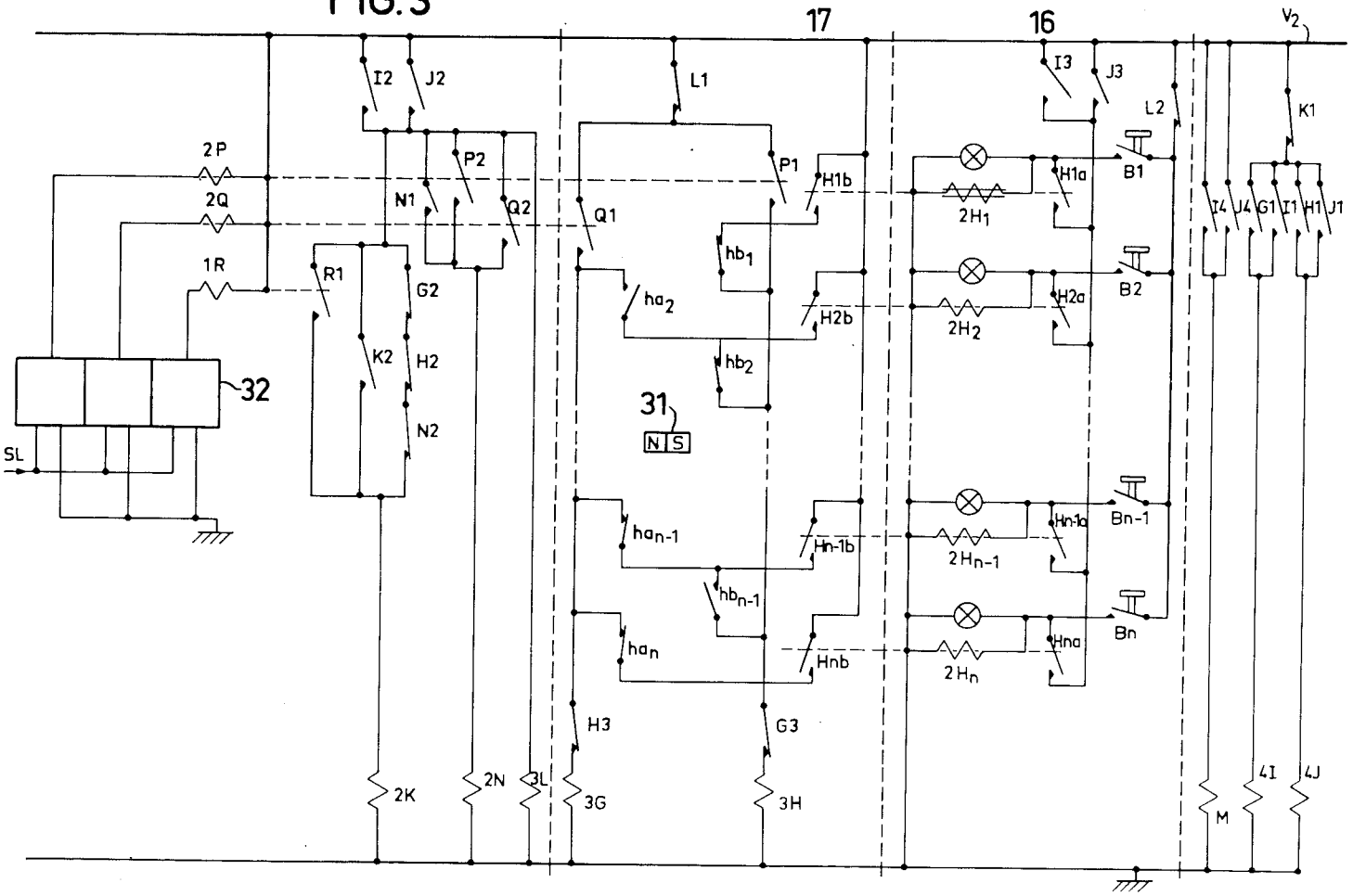

In FIGS. 2 and 3 a circuit diagram of an embodiment of a selector system is shown used as a floor selector system for an elevator. With the floor selector system shown in these figures only one floor at a time can be selected. At each halt plane a switch Al–An is provided at each halt plane door, which switch is closed when a floor is selected by a person on that floor pressing the CALL button. Thereby a relay winding $2S_i$ in series with the activated switch A*i* is connected to a voltage source $V_1$ so that the relay is activated. Across the relay winding $2S_i$ an indicator lamp $l_i$ is connected to indicate that the relay has been activated. Upon the activation of the relay $2S_i$ a contact $S_i^2$ in the floor position indicator 13 is closed, one terminal of said contact being connected to the voltage source $V_1$ and the other terminal connected to one terminal of the two bistable elements $sa_i$ and $sb_i$ associated with the selected floor plane, which elements in this embodiment each are formed by a switch actuable by a magnet positioned at the lift cage, so that $sa_i$ is switched to a closed state by an ascending lift cage and to an open state by a descending lift cage, and $sb_i$ to a closed state by a descending lift cage and to an open state by an ascending lift cage.

The second terminals of all elements $sa_i$ are interconnected and connected to one terminal of a relay winding 5C, the other terminal of which is grounded, and the second terminals of all elements $sb_i$ are interconnected and connected to one terminal of a relay winding 5D, the other terminal of which is connected to ground. If the lift cage is located above the selected floor plane the switch $sa_i$ is closed and the switch $sb_i$ open so that the relay winding 5D in series with the closed relay contact $S_i2$ and the closed switch $sa_i$ is activated. If, on the other hand, the lift cage is located below the selected floor plane, the switch $sb_i$ is closed and the switch $sa_i$ open so that, in this case, the relay winding 5D in series with the closed relay contact $S_i2$ and the closed switch $sb_i$ is activated. The index *i* always refers to the floor associated to the bistable element, and the floors are counted from the top so that floor 1 is the highest and floor *n* the lowest of the floors. It should be observed that a bistable element is not required for the top floor as the elements $sa_i$ are included in a circuit which upon activation indicates that the elevator is to travel downwards. Similarly, no bistable element $sb_n$ is required for the bottom floor as the elements $sb_i$ are included in a circuit which, when activated, indicates that the elevator is to travel upwards.

When one of the relay windings 5C or 5D are activated it opens a contact C5 or D5, respectively, in series with the other relay winding, whereby—if a selection of floor happens to take place simultaneously at two different floor planes—only one of the relays 5C or 5D is activated, i.e. the relay effecting the fastest opening of its contact C5 or D5, respectively.

When the relay winding 5C is activated it also operates two contacts C1 and C2 included in a line connected to a block DOWN in a transmitter 23 and to the voltage source $V_1$, the contact C1 being normally closed and the contact C2 normally open, and when the relay winding 5D is activated it operates two contacts D1 and D2 included in a line connected to a block UP in the transmitter 23 and to the voltage source $V_1$, the contact D1 being normally open and D2 normally closed. These contacts are so operated that the normally open contact C2 or D2, respectively, first is closed and, after a certain delay, the normally closed contact C1 or D1 is opened so that the block in the transmitter 23, in the supply line of which the contacts are included, will have voltage applied during the short time interval that the two contacts in the line are closed simultaneously. This block emits during this short time interval a tone signal, having a frequency typical for the block, to a receiver 32 shown in FIG. 3 positioned in the lift cage at which, in the embodiment described, the drive machinery for the elevator is mounted. As the transmitted tone signal has a short duration it can be transmitted along the protection conductor in the supply cable of the elevator, but it may also, of course, be transmitted wirelessly.

The signal received by the receiver 32 in FIG. 3 operates selectively the block UP in the receiver, if it was emitted by the block UP in the transmitter 24, and the block DOWN, if it was emitted by the block DOWN in the transmitter, due to the fact that the frequencies of the two signals are different from each other and the blocks are provided with filter means for filtering out the frequency designated to the particular block.

When the block UP in the receiver 32 receives a signal it activates a relay winding 2P, and when the block DOWN receives a signal it activates a relay winding 2Q. When the winding 2P is activated it closes a contact P1 which, in series with a relay winding 3H and a normally closed contact L1, is connected between a voltage source $V_2$ and ground, whereby the relay winding 3H is activated. In addition a contact P2 is closed which is connected in series with a relay winding 2N and a parallel connection of a normally open and to a relay 4J associated contact J2, and a normally open and to a relay 4I associated contact I2, the relay winding 2N, however, not being activated due to the open contacts I2 and J2. In parallel with the contact P2 a normally open contact Q2 is connected which is closed if instead the block DOWN in the receiver 32 should receive a signal. A normally open, to the relay 2Q associated contact Q1 is connected in series with the contact L1 and a relay winding 3G.

When the relay 3H is activated by the UP relay 2P it closes a normally open contact H1 connected in series with the relay winding 4J and a normally closed contact K1 between the voltage source $V_2$ and ground, whereby the relay 4J is activated and closes a normally open contact J1, connected in parallel with the contact H1, so that the relay 4J will be holding itself through this contact.

If instead the relay 2N is activated by the DOWN relay 2Q via the contact Q2 it closes a normally open contact G1 connected in series with the contact K1 and a relay winding 4I between the voltage source $V_2$ and ground, whereby the relay 4I is activated and closes a normally open contact I1 in parallel with the contact G1, so that the relay 4I will be holding itself through this contact.

When activated, the relay 4J operates a contactor (not shown) which closes a supply line to the drive motor or motors so that the motor or motors is imparted a rotation direction for driving the elevator upwards. The relay 4I operates, when activated, a contactor (not shown) for closing a supply line to the drive motor or motors so that it or they is imparted a rotation direction for driving the elevator downwards.

When the drive motors are energized this is sensed by a slow-acting current relay 3E connected to the supply cable for the elevator so that said relay is activated (see FIG. 2). When the relay 3E is activated it closes a contact E1 having its one terminal connected to the voltage source $V_1$ and having its other terminal connected to a common point for one terminal of a normally open contact $S_i1$ associated to each relay winding $2S_i$, the other terminal of the contact $S_i1$ being connected to the connection point between the associated relay winding $2S_i$ and the switch A*i*. When the contact E1 is closed a holding circuit is therefore closed for the relay $2S_i$ which previously had been activated by the closing of the switch A*i* which started all the sequence of events stated above. Further, a normally closed contact E2 or F1, which is connected between the interconnected terminals of the switches A*i*, remote from the relay windings $2S_i$, and the voltage source $V_1$, is opened. This contact may either be a contact of the relay 3E, which contact when the relay is activated is opened after the closing of the contact E1, or it could be a contact associated to a relay winding 1F connected between the voltage source $V_1$ and ground in series with a normally open contact E3, operated by the relay 3E, whereby it is secured that the contact F1, operated by the relay 1F, is opened only after the closing of the contact E1. No new selection of floor can take place until the relay 3E has been deactivated. The lift cage is moving on its way to the floor plane desired.

Referring again to FIG. 3, also one of the contacts I2, J2, is closed when one of the relays 4I, 4J is activated, whereby the relay 2N is activated as, when this occurs, the receiver 32 is adapted to hold the relay 2P or 2Q, respectively, activated during a sufficiently long time after having received one of the signals for UP or DOWN for the relays 4I and 4J to have time to operate. The activated relay 2N closes a normally open holding contact N1 connected in parallel with the contacts P2 and Q2. Thereafter the activated relay 2P or 2Q can be deactivated, and the elevator is still operated to be driven.

In FIG. 2 the contact A2 is shown activated, and the elevator is located below the floor at which the switch A2 is positioned. The relay 5D is held activated via the closed contacts $S_22$ and $Sb_2$. When the lift cage with the magnet 21 has arrived sufficiently near the floor with the contact A2, the contact $sb_2$ is opened by means of the switching magnet 21. Consequently, the relay 5D is deactivated whereby two contacts D3 and D4 connected in a line to the voltage source $V_1$ from a block STOP in the transmitter 23 are operated by the relay 5D in such a way that a contact D3, having been closed by the activating of the relay 5D, is opened only after a suitably long time after the closing of the contact D4. Activating the relay 5D opens the contact D4 before the closing of the contact D3 so that no activating of the block STOP can take place. Parallelly connected with the contacts D3 and D4 are two contacts C3 and C4 which are operated in the same way as D3, D4 but by the relay 5C.

During the time that the block STOP in the transmitter 23 is connected to the voltage source $V_1$ via the contacts D3, D4 or C3, C4, a third type of signal is transmitted to the receiver 32 in FIG. 3 which signal differs from the first and the second signal by its frequency. This signal is picked up selectively by the block STOP in the receiver 23 which activates a relay 1R. This relay closes a normally open contact R1 which is connected parallelly with a series connection of a normally closed contact G2 controlled by the relay 30, a normally closed contact H2 controlled by the relay 3H and a normally closed contact N2 controlled by the relay 2N. When the elevator is operated to travel upwards or downwards by the receiver 32, either G2 or H2 will be first opened by the row activated relay 3G or 3H. When the relay 2N is activated it opens the contact N2, and the opened contact G2 or H2 is then closed owing to that the slow-acting relay opens the contact L1 to deactivate the activated relay 3G or 3H. The purpose with this series connection will be described more in detail further on in the specification. When the elevator is travelling upwards or downwards under the control by the receiver 32, consequently at least the contact N2 is opened whereby a relay 2K, connected in series with the above-mentioned parallel connection and the parallel connection of the contacts I2 and J2 between ground and the voltage source $V_2$, is maintained deactivated until the relay 1R is activated. When the relay IR is activated and the content R1 is closed the relay 2K is activated and closes a contact K2, connected in parallel with the contact R1, for holding the relay 2K. The relay also opens the contact K1 whereby the previously activated relay 4I or 4J is deactivated. The activation of the relay 4I or 4J opens the previously closed contact I2 or J2, whereby the relays 2K, 2N and 2L are deactivated.

Between ground and the voltage source $V_2$ also a relay M is connected in series with a parallel connection of a normally opened contact I4 controlled by the relay 4I and a normally opened contact J4 controlled by the relay 4J. This relay controls the brake function of the elevator in such a way that a braking action is always present when the relay M is deactivated, and is only cancelled when it is activated. When the activated relay 4I or 4J is is deactivated and the contact I4 or J4 is opened, the elevator is consequently braked. An additional contactor for the supply line of the elevator is also opened, which contactor is maintained open until a certain time has passed after the stopping of the elevator.

The elevator is also provided with a floor selector 16 and a floor position indicator 17, both disposed in the lift cage and operating after the same principle as the floor selector 12 and the floor position indicator 13 for the halt planes. Thus, the switches B1–Bn corresponds to the switches A1–An, and the relays $2H_1$–$2H_n$ with associated contacts to the relays $2S_1$–$2S_n$ with associated contacts, the contacts $ha_2$–$ha_n$ to the contacts $sa_2$–$sa_n$, the contacts $hb_1$–$hb_{n-1}$ to the contacts $sb_1$–$sb_{n-1}$, the relay 3G to 5C, and the relay 3H to 5D. Further is, as stated earlier, also between the relay 3G and the voltage source $V_2$ a series connection of the contacts Q1 and L1 connected, and between the relay 3H and the voltage source $V_2$ a series connection of the contacts P1 and L1 connected.

Figure 4:
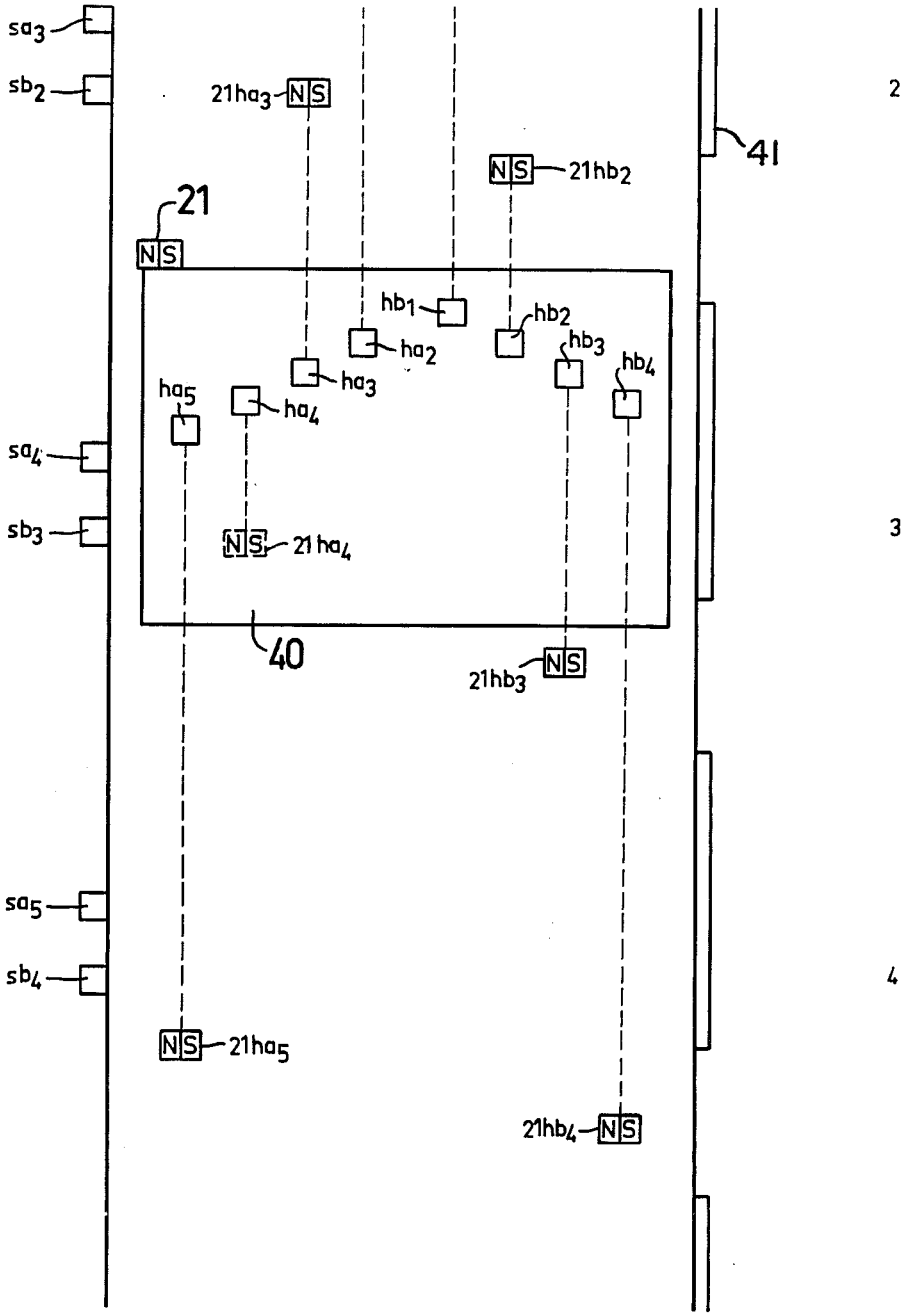

The contacts $ha_2$–$ha_n$ and the contacts $hb_1$–$hb_{n-1}$ are positioned beside each other transversally of the travel direction of the elevator so that they can be operated selectively by magnets mounted in the elevator shaft. FIG. 4 shows schematically a lift cage 40 provided with switches $ha_2$–$ha_5$ and $hb_1$–$hb_4$ switchable by a magnetic field; the elevator has five halt planes. The switches are positioned beside each other transversally of the moving direction of the elevator and are switchable by magnets 21$ha_2$–21$ha_5$ and 21$hb_1$–21$hb_4$ mounted in the elevator shaft, the designation after 21 indicating the switch to which a respective magnet is associated. When a magnet arrives at a position directly opposite the associated switch it switches-over the switch. The magnets 21$ha_2$–21$ha_5$ are positioned such in the shaft that they switch-over the switches $ha_2$–$ha_5$ to an open state when the elevator is descending, and the magnets 21$hb_1$–21$hb_4$ are positioned such that they switch-over the switches $hb_1$–$hb_5$ to an open state when the elevator is ascending, at such a distance from the floor plane associated to the respective switches, that the elevator after the opening of the switch is able to stop at that particular floor plane. In FIG. 4 dashed lines are drawn between every cooperating pair of magnet and switch. Three halt plane doors are shown, in front of which the elevator must be able to stop. Assuming that the elevator is ascending and is to stop in front of the door at the halt plane 2 and the elevator is operated from the lift cage, the switch $hb_2$ is opened by the magnet 21$hb_2$ when the elevator has reached a position for which the magnet registers with the switch whereafter the elevator is braked so that it will come to a standstill opposite the door 41.

Referring again to FIG. 3, a relay $2H_i$ is activated when a floor is selected by the closing of the switch B*i*, whereby, in the same manner as that described for the corresponding circuit in FIG. 2, a circuit is closed for the relay 3G, if the elevator is located above the selected halt plane, or for the relay 3H, if the elevator is located below the selected halt plane. The relay 4I or 4J is then activated by the activated relay in the same way as already described. Thereby the drive machinery is started to drive the elevator downwards or upwards, the relay M is activated so that the brake system of the elevator is released, and the contact I2 or J2 is closed so that the relay 3L is activated, whereas the relay 2K is deactivated owing to that the contact G2 or H2 is maintained open by its associated activated relay. Further there is a parallel connection of two normally open contacts I3 or J3, which parallel connection is connected in a holding circuit for the relays 2H*i* at the corresponding location as the contact E1 in the circuit shown in FIG. 2 and with the same function. The contact I3 is controlled by the relay 4I and the contact J3 by the relay 4J so that one of these contacts is closed when one of the relays 4I, 4J is closed, and the relay 2H*i*, activated when a floor is selected, is held via its closed contact H*ia* and the closed contact I3 or J3. After the activation of the relay 3L a normally closed contact L2, connected in series with a parallel connection of all selector units B*i* and 2H*i*, is opened, said contact L2 corresponding to the contact E2 or R1 in FIG. 2 and having the same function so that no new selection of floor can take place while the elevator is moving.

When the elevator has moved so near the halt plane at which to stop that the switch-over magnet associated to this floor plane, and acting on the closing contact $ha_i$ or $hb_i$ connected in series with the closed switch *hib*, registers with this contact the circuit for the activated relay 3G or 3H is opened so that this relay is deactivated. The previously opened contact G2 or H2 is closed so that the relay 2K is activated and opens the contact K1, and the activated relay 4I or 4J is deactivated and interrupts the supply to the drive machinery of the elevator. Further the contact I4 or J4 is opened so that the relay M is deactivated whereby the brake system of the elevator is energized. The closed contact I2 or J2 is also opened whereby the relays 2K and 3L are deactivated and the selector system is prepared for a new selection of floor. It should be noted that as soon as voltage is applied to the drive machinery of the elevator the relay 2E is activated, and because of the opening of the contact E2 or F1 the selector unit 12 is blocked so that a selection of floor cannot take place at the halt planes during the drive of the elevator.

Figure 5:
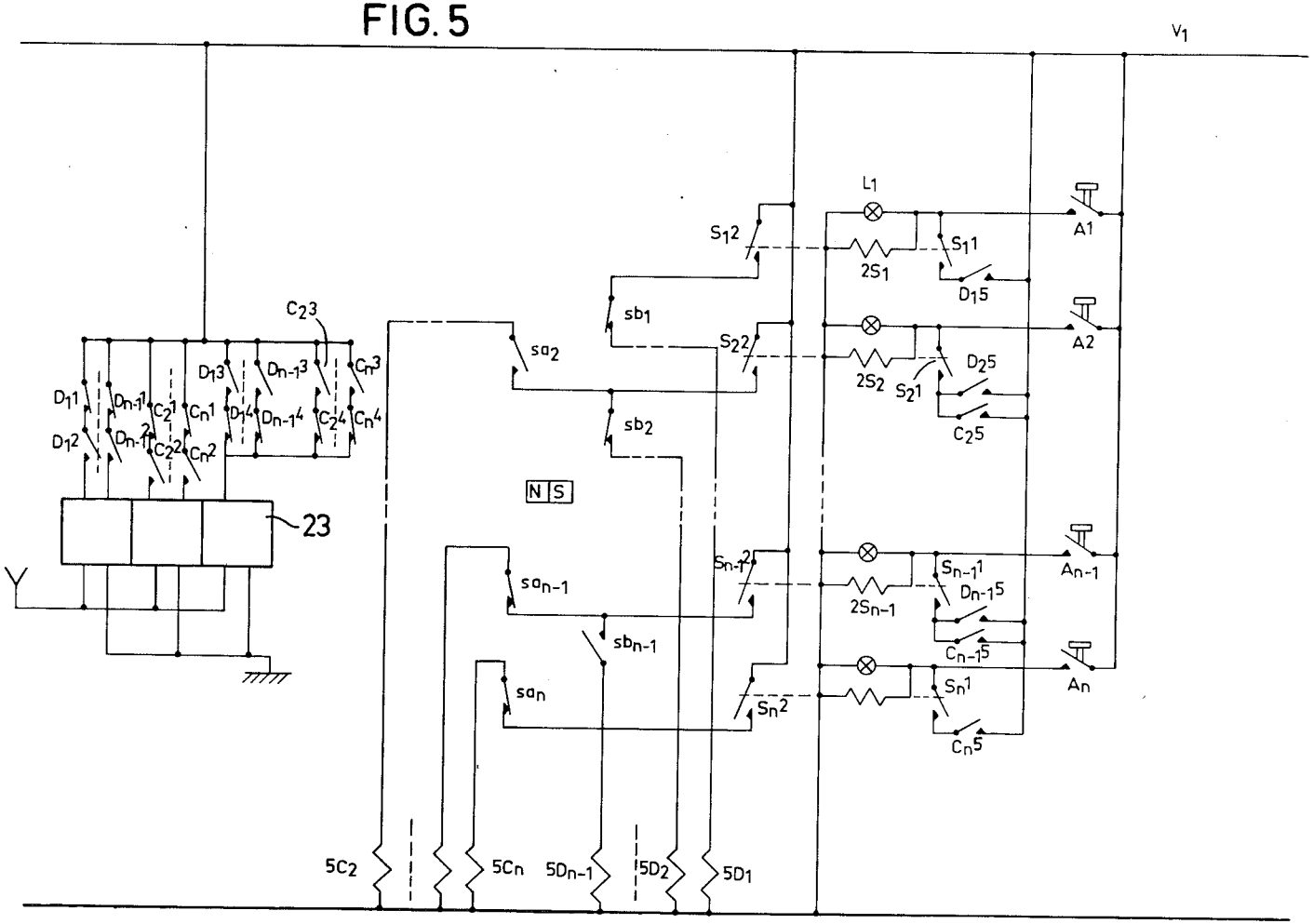
FIGS. 5 and 6 show an embodiment of a selector system of the invention for an elevator having a wait system.
Figure 6:
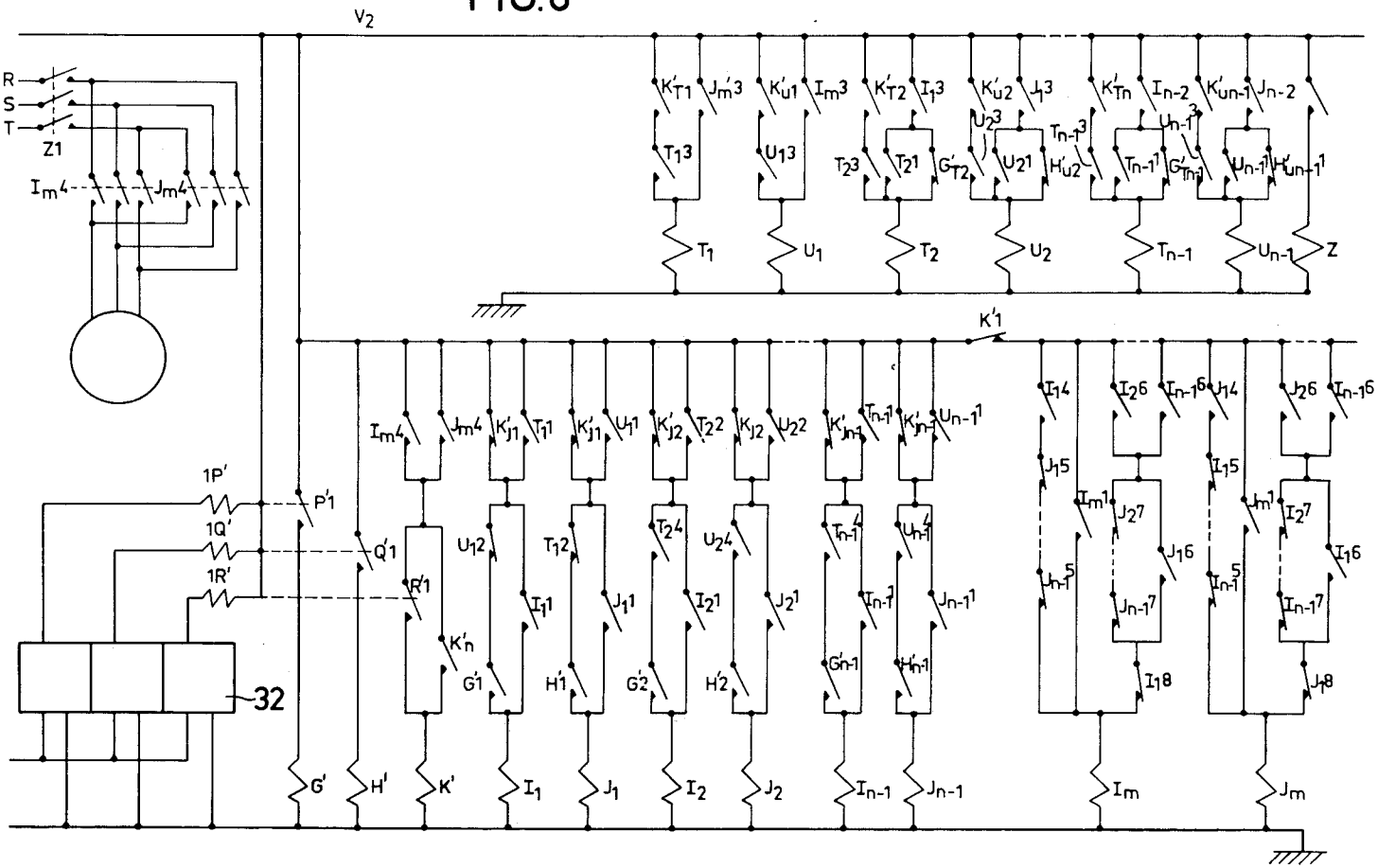

FIGS. 5 and 6 show a schematic diagram for a floor selector system for an elevator enabling a selection of a plurality of floors, and the elevator travels to these floors in turn.

FIGS. 5 and 6 show an example of the fact that the concept of the invention also can be used for a selection of a plurality of halt planes or, as is especially shown in the figures, for an elevator with selection of a plurality of floors where the elevator stops at the selected floors in turn according to the order in which the selected floors occur along the travelling path, and that the selected floors which are not in the travelling direction of the elevator are put in a waiting list in order that the elevator is to stop at these floors when it is travelling in the opposite direction.

The circuit shown in FIG. 5 differs from that shown in FIG. 2 in that each bistable element $sa_i$, $sb_i$ is connected in series with a different relay winding $5C_i$ and $5D_i$, respectively, and that all relays $5C_i$ have two contacts $C_i1$ and $C_i2$ connected in series to the block DOWN in the transmitter 23 where, for an activation of the relay $5C_i$, a closing of the contact $C_i2$ takes place before an opening of the contact $C_i1$, whereby the block DOWN is activated to transmit a tone signal during the time both contacts are closed, and that, for a deactivation of the relay $5C_i$ the opening of the contact $C_i2$ takes place before the closing of the contact $C_i1$. All series connections of the contacts $C_i1$ and $C_i2$ are in parallel connection with each other. In parallel connection between the drive voltage source $V_1$ and the block UP in the transmitter 23 are contacts $D_i1$ and $D_i2$ in series connection, associated to each relay $5D_i$, and having the same function as the contacts $C_i1$ and $C_i2$ but operated by the relays $5D_i$ so that for each activation of one of the relays $5D_i$ the block UP is connected to the voltage source during a short time interval and emits a tone signal. In parallel connection between the drive voltage source $V_1$ and the block STOP in the transmitter 23 there are further series connections of contacts $C_i3$ and $C_i4$, and $D_i3$ and $D_i4$, respectively, associated to each relay $5C_i$ and $5D_i$ and operated these relays in such a way that, for an activation, opening of the contact $C_i4$ or $D_i4$, respectively, takes place before the closing of the contact $C_i3$ or $D_i3$, respectively, so that the block STOP is not connected to the voltage source $V_1$, but for a deactivation of one of the activated relays, the closing of the contact $C_i4$ or $D_i4$, respectively, takes place before the opening of the contact $C_i3$ or $D_i3$, respectively, and the block STOP is connected to the voltages source during the time interval that both contacts are closed, and the transmitter 23 emits a tone signal to indicate that the elevator or vehicle is to stop at the next halt plane or floor in the travelling direction. Further, instead of the contact E1 in FIG. 2 there is a contact for each relay $5C_i$ and $5D_i$, which is operated by means of the relay $2S_i$, one of which contacts being connected in series with a contact $C_i5$ or $D_i5$, respectively, connected to the contact $S_i1$, the contacts $C_i5$ and $D_i5$ being connected in parallel with each other.

As with the circuit shown in FIG. 2 there is no switch ($sa_1$) for the top floor and, thus, no relay ($5C_1$) and switch ($sb_n$) for the bottom floor and no relay ($5D_n$). A circuit of the type shown in FIG. 5 is provided for each place from which it is desired to operate the elevator, i.e. a circuit for the halt planes and a circuit comprising switches $sa_i$, $sb_i$ positioned as the switches $ha_i$, $hb_i$ in FIG. 4 for the lift cage. If the circuit is to be used for controlling another type of vehicle, an additional circuit for control from a separate central can be used.

At the drive machinery is the control circuit shown in FIG. 6 positioned which in the embodiment shown is controlled by only one circuit of the type shown in FIG. 5 but which, as will be explained later, may be enlarged to be controlled by a plurality of circuits. The control circuit comprises a receiver 32 for receiving the tone signals emitted by the transmitter 23. The circuit includes a plurality of relays $I_1$–$I_{n-1}$ which are activated in turn by each UP signal received and passed on by the receiver 32, and relays $J_1$–$J_{n-1}$ which are activated in turn by all DOWN signals received and passed on by the receiver 32. Further, there is a relay K' which is activated every time the receiver 32 receives and passes on a tone signal STOP. If it initially is assumed that the elevator is at rest and that none of the relays $5C_i$ and $5D_i$ in FIG. 5 is activated, and that then someone desires that the elevator is to travel to a floor plane above the plane at which the elevator is located, one of the relays $5D_i$ is activated and makes the transmitter 23 emit a tone signal for UP which is received by the receiver 32 in FIG. 6. Now the relay $I_1$ is activated owing to that the tone signal activates the relay 1P' which by closing its normally open contact P'1 activates the relay G' which closes its normally open contact G'1, connected in series with a normally closed contact $U_12$ and a parallel connection of a normally closed and a normally open contact $K'_{I1}$ or $T_1'$, respectively, and the relay $I_1$. The relay $I_1$ is held by closing its normally open contact $I_11$ connected in parallel with the contacts G'1 and $U_12$. When the relay $I_1$ is activated it also closes a normally open contact $I_13$ connected in series with a normally closed contact $G'_{T2}$ opened by the activated relay G', and a relay winding $T_2$. When the relay G' is activated the relay $I_1$ is also activated and closes its contact $I_13$, but the relay $T_2$ is not activated until the relay G' has been deactivated due to the opening of the contact $G'_{T2}$, but when the UP signal has ceased and said contact has been closed the relay $T_2$ will be held, as long as the relay $I_1$ is activated, by the closing of a contact $T_21$ connected in parallel with the contact $G'_{T2}$. Thereby a contact $T_24$ is closed which is connected in series with a normally open contact G'2 and a relay winding $I_2$ and a parallel connection of a normally closed and a normally open contact $K'_{I2}$ and $T_22$, respectively.

If a further relay $5D_i$ is activated and the receiver 32 receives a tone signal for UP, the relay G' is again activated, and then the relay $I_2$ is activated by the closing of the contact G'2 and will be held by the normally open contact $I_21$ connected in parallel with the contacts $T_24$ and G'2. After deactivating of the relay G' the relay $T_3$ is activated in a manner similar to that for the relay $T_2$, and a contact in series with the next relay $I_3$ is closed so that it can be activated when the next signal for UP is received, etc.

When the relay $I_1$ is activated, also a normally open contact $I_14$ in series connection with normally closed contacts $J_15$–$J_{n-1}5$ and a relay winding $I_m$ is closed so that the relay $I_m$ is activated and is held by a normally open but now closed contact $I_m1$ in parallel connection with said series connection of contacts. The relay $I_m$ operates, when activated, a contactor (not shown) which closes a supply line to the drive motor or motors, so that the motor or motors are imparted a rotation direction to drive the elevator upwards. The relay $I_m$ also closes a normally open contact $I_m4$ which is connected in series with a normally open contact R'1 and a relay winding K' which, however, is not activated due to the open contact R'1. Further, the relay $I_m$ closes a normally open contact $I_m3$ in series connection with a relay winding $U_1$, whereby the relay $U_1$ is activated and closes a normally open contact $U_11$ which is connected in parallel with a normally closed contact $K'_{J1}$. This parallel connection is connected in series with a normally closed contact $T_12$, a normally open contact H'1 and the relay winding $J_1$.

If a signal for DOWN is received by the receiver 32 while the elevator is ascending the relay $J_1$ is activated by the closing of the contact H'1 and is held by the contact $J_11$ connected in parallel with the contacts $T_12$ and H'1. Owing to that one or more of the relays $I_i$ are activated, the relay $J_m$ is not activated by the closing of the normally open contact $J_14$ connected in series with the normally closed contacts $I_15$–$I_{n-1}5$ and the relay winding $J_m$. The activating of the relay $J_1$ activates, when the relay H' is deactivated, a relay $U_2$ which is connected in a circuit similar to the relay $T_2$.

The activating of the relay $U_2$ closes a contact in series connection with the relay $J_2$ which is activated at the receipt of a possibly following DOWN signal. The control and connecting-in of the relays $J_i$ and $U_i$ is quite similar to that of the relays $I_i$ and $T_i$ except that they are controlled by received DOWN signals instead of by UP signals.

When the elevator reaches a floor plane at which to stop, an activated relay $5D_i$ in FIG. 5 is deactivated, and the transmitter 23 emits a tone signal STOP which is received by the receiver 32 which then activates a relay 1R' which closes the contact R'1 so that the relay K' is activated. Thereby a normally closed contact $K'_i$, connected in series with each relay $I_i$, is opened. Then only the relay $I_1$ is initially deactivated as a contact $T_11$, connected in parallel with the contact $K'_{i1}$, is open and as the relay $J_m$ is not activated at the time for the activating of the relay K' which, besides, is of the type that it when activated closes its closing contacts before its opening contacts are opened.

When the contacts $K'_{Ti}$ and $K'_{Ui}$ are closed the already previously activated relays $T_i$ and $U_i$ are still activated owing to that the contacts $T_i3$ and $U_i3$, respectively, connected in series with the contacts $K'_{Ti}$ and $K'_{Ui}$, were closed when the relay K' was activated. Thereby those of the activated relays $I_1$ and $J_i$, respectively, for which the corresponding relay $T_i$ or $U_i$ is activated, are still maintained activated via the closed contacts $T_i1$ or $U_i1$. It should be noted that only one of the relays $I_i$ and $J_i$ is activated, viz. the relay which by its action earlierly has activated the relay $I_m$ or the relay $J_m$. When the relay K' is deactivated, that relay $I_m$ or $J_m$ is deactivated which has controlled the drive motor, but the earlierly activated, and by these relays activated, relay $U_1$ or $T_1$ is maintained activated by the series-connected contacts $K'_{U1}$, $I'_m3$ or $K'_{T1}$, $J'_m3$. Assuming that it was the relay $I_1$ which activated the relay $I_m$, this relay will be deactivated when the relay K' is operated owing to that the contact $T_11$, connected in series with this relay, is open. This is the only one of the activated relays besides the relay $I_m$ which is deactivated. The relay $J_1$ is held activated owing to that the relay $U_1$, because of the normally open contact $I_m3$, was maintained activated by the relay $I_m$ and after the activating of the relay K' is maintained activated by the contacts $K'_{U1}$ and $U_13$.

When the relay $I_m$ is deactivated the contactor $I_m4$ for the supply line of the elevator is opened. Further a relay Z is operated in a manner known per se, which is not described in more detail as it is part of the invention, said relay opening an additional contactor Z1 in the supply line of the elevator, and the relay Z is maintained deactivated by means of circuits not shown until the elevator has stopped at a floor plane and thereafter during a certain delay time. Further, the relay Z is operated by the safety circuits of the elevator so that the contactor Z1 is maintained open as soon as an elevator door is open or a safety circuit has been operated.

When the relay $I_m$ is deactivated also the relay K' is deactivated and the contact K'1 in series with the relays $I_m$ and $J_m$ is closed. Thereby the relay $I_m$ is again activated if any other relay $I_i$ is activated through the parallel connection of the contacts $I_i6$ in series with the parallel connection of a contact $J_16$ and the series connection of the contacts $J_27$–$J_{n-1}7$ and the now closed contact $I_18$. If any of the relays $J_i$ is activated the current flows through the contact $J_16$, but otherwise through the path $J_27$–$J_{n-1}7$. By means of the relay $I_m$ the relay $U_1$ is activated whereby the contact $U_12$ is maintained open so that an UP signal will not be able to activate the relay $I_1$ during the time that the elevator is ascending.

At the receipt of the next STOP signal the relay $I_2$ is deactivated as the relay $T_2$ has not been activated by the relay $I_1$. If the relay $I_3$ is activated, the relay $I_m$ is activated next time under the influence of said relay which drops at the then following STOP signal etc., until all relays $I_i$ are deactivated. When all the relays $I_i$ are deactivated the relay $J_m$ is activated via the series connection of the normally open contact $J_14$ and the normally closed contacts $I_15$–$I_{n-1}5$ and the same procedure for the DOWN relays $J_i$ is repeated as earlierly for the UP relays $I_i$. All relay circuits for the relays $J_i$ are similarly constructed as the corresponding relays $I_i$.

The number of relays $I_m$ and $J_m$ corresponds, if the circuit in FIG. 6 is controlled by only one circuit of the type shown in FIG. 5, to the number of relays $5D_i$ and $5C_i$, i.e. the number of floors minus one, but if the circuit in FIG. 6 is to be controlled by more than one circuit of the type shown in FIG. 5, the number of relays shown in FIG. 6 is to multiplied by the number of circuits of the type shown in FIG. 5. In this case it must be secured that the signals for STOP, i.e. the relays $5C_i$ and $5D_i$, are deactivated at different points of time before the elevator reaches a floor plane at which to stop so that if one at two places, e.g. both in the elevator and at a halt plane, desires the elevator to stop at a particular floor, is provided with two cycles for activating and deactivating the particular relay $I_m$ or $J_m$ so that two activated relays $I_i$ or $J_i$ are deactivated, as two relays had been activated for the same floor plane.

The circuits shown in FIGS. 2, 3 and 5, 6 are only to consider as examples, not restricting the inventional idea. Especially the circuit shown in FIG. 6 may advantageously be replaced by an electronic circuit which e.g. operates with shift registers and gate circuits and which operates the relays $I_m$ and $J_m$ in the same manner as the circuit shown in FIG. 6.

As an alternative to the arrangement shown in FIG. 4 the laterally distributed magnets $21ha_2$–$21ha_5$ could be replaced by a single column of spaced pins—two for each halt plane—acting on the arms of a rotatable cross mounted at the vertical lift cage. The cross is connected to drive a gear wheel engaging a vertical rack. The rack is connected to a plate having laterally stepped edges each step registering a switch corresponding to the switches $ha_2$–$ha_5$ and $hb_1$–$hb_4$. Thus, the switches are consecutively operated by said steps when the cross is rotated in response to the pins.

What is claimed is:

1. A halt selector system for a vehicle movable along a defined path, comprising at least one switching circuit positioned remotely from the drive machinery of the vehicle for selecting a halt position for said vehicle, said switching circuit including means operative to sense the position of the vehicle with respect to a selected halt position and, in response to the position of the vehicle with respect to said selected halt position, to control a transmitter to emit first and second different frequency signals to a receiver which is positioned adjacent the drive machinery of the vehicle and which is connected to an operating unit for said drive machinery, said first signal being operative to effect activation of a control circuit in said operating unit to indicate that the vehicle is to be driven in one direction, and said second signal being operative to effect activation of said control circuit in said operating unit to indicate that the vehicle is to be driven in the opposite direction, said transmitter also being operative to emit to said receiver a third signal, distinguishable from each of said first and second signals, for deactivating said control circuit to cause said vehicle to be stopped at the nearest halt position in the travel direction of the vehicle, said switching circuit including, for each halt position, at least one bistable unit which is adapted to assume one state when the vehicle is located at one side of the halt position and to assume its other state when the vehicle is located at the other side of said halt position, a switch-over device for switching the state of said bistable unit when said vehicle is moving along said path and is at a predetermined distance from a halt position such that said vehicle can be stopped at said halt position, and control means responsive to the state of said bistable unit for activating the transmitter to emit said first signal if the vehicle is located at one side of the halt position or to emit said second signal if the vehicle is located at the other side of the halt position, said control means being operative, when the vehicle has arrived at a halt position at which it is to stop, to activate the transmitter to emit said third signal in response to the switching of the state of said bistable unit.

2. A halt selector system according to claim 1, wherein the bistable units are magnetically controlled switches switched by a magnetic field.

3. A halt selector system according to claim 1 wherein two of said bistable units are provided for each halt position, one of said units assuming a current-closing state when the vehicle is located at one side of the halt position and a current-breaking state when the vehicle is located at the other side thereof, and the second of said units assuming opposite states, the bistable unit which is in a current-closing state being controlled to switch-over its state when the vehicle is approaching and at a prescribed distance from the halt position to be able to stop there, and the bistable unit which is in a current-breaking state being controlled to switch-over its state after the vehicle has passed the halt position.

4. A halt selector system according to claim 3, wherein, when a selection of halt takes place, a circuit is closed through the current-closing bistable unit for the particular halt, which circuit is closed until the vehicle has reached a prescribed distance from the halt to be able to stop there, whereby the circuit is opened owing to that the bistable unit is switched-over to a current-breaking state.

5. A halt selector system according to claim 1, wherein the bistable units are positioned at every halt position and are switched-over by a switch-over device positioned on the vehicle.

6. A halt selector system according to claim 1 wherein the bistable units are positioned on the vehicle, and each bistable unit is adapted to be switched-over selectively by switch-over devices positioned at each halt position.

* * * * *